US006255547B1

(12) United States Patent
Smuda

(10) Patent No.: US 6,255,547 B1
(45) Date of Patent: Jul. 3, 2001

(54) METHOD OF OBTAINING LIQUID FUELS FROM POLYOLEFINE WASTES

(75) Inventor: Heinrich Smuda, Ben Gurion Ring 126, D-60437 Frankfurt/Main (DE)

(73) Assignee: Heinrich Smuda (DE)

( * ) Notice: Subject to any disclaimer, the term of this patent is extended or adjusted under 35 U.S.C. 154(b) by 0 days.

(21) Appl. No.: 09/254,847

(22) PCT Filed: Sep. 19, 1997

(86) PCT No.: PCT/IB97/01125

§ 371 Date: Mar. 15, 1999

§ 102(e) Date: Mar. 15, 1999

(87) PCT Pub. No.: WO98/15603

PCT Pub. Date: Apr. 16, 1998

(30) Foreign Application Priority Data

Oct. 10, 1996 (DE) ..... 196 41 743

(51) Int. Cl.[7] ..... C10G 1/10; C07C 1/00
(52) U.S. Cl. ..... 585/241; 201/2.5; 201/25
(58) Field of Search ..... 585/240, 241, 585/242; 201/2.5, 25

(56) References Cited

U.S. PATENT DOCUMENTS 4,542,239 9/1985 Lamparter et al. .
4,584,421 4/1986 Saito et al. .
4,982,027 * 1/1991 Korff et al. ..... 585/240

FOREIGN PATENT DOCUMENTS 196 29 042 7/1996 (DE) .
0 577 279 1/1999 (EP) .
149 887 6/1990 (PL) .

* cited by examiner

*Primary Examiner*—Bekir L. Yildirim
(74) *Attorney, Agent, or Firm*—Larson & Taylor, PLC

(57) ABSTRACT

The subject of the invention is the method of obtaining liquid fuels from polyolefine wastes. According to the method, properly disintegrated polyolefines in an amount of 100 parts y weight are heated in the temperatures between 300° C. to 450° C. till the moment of a decay of volatile product forming, in the presence of heavy metals silicates as catalysts, added in amounts of 1–30 parts by weight. As catalyst, the silicates of iron $Fe^{3+}$, cobalt $Co^{2+}$, nickel $Ni^{2+}$, manganium $Mn^{2+}$, chromium $Cr^{3+}$, copper $Cu^{2+}$, zinc $Zn^{2+}$, cadmium $Cd^{2+}$ and/or their mixtures are used. The catalyst is applied in an amorphic form in an amount from 5 to 10 % by weight, calculated on the mass of the raw material. The catalyst is recycled and used multiply. A process is run in a continous way.

16 Claims, No Drawings

METHOD OF OBTAINING LIQUID FUELS FROM POLYOLEFINE WASTES

FIELD OF THE INVENTION

A subject of the invention is the method of obtaining liquid fuels from polyolefine wastes.

BACKGROUND OF THE INVENTION

Heretofore from the Polish patent description no. 149887 there is known a method of obtaining liquid fuels from atactic polypropylene, according to which raw material is subjected to a thermodegradation process at temperatures between 180° C. to 340° C., introducing air into a reaction system. During the process according to the known method the fractionated reception and condensation of products are kept.

European patent application no. 0577279 A1 teaches a method of polymer processing, which is based on thermal decomposition of polyolefines, poly/vinyl chloride/ and poly/ethylene terephtalate/ at temperatures from 300°C. to 600° C. in a stream of a hot gas free of oxygen. The process runs in the presence of a catalyst in a form of zeolytic clay, amorphic aluminium silicate, silica, quartz, aluminium, zirconium, ash and calcium oxide.

In the above method, the use of a fluidized reactor is necessary. The resultant products are characterised in a broad range of a molecular weight distribution.

U.S. Pat. No. 4,584,421 teaches a method of decomposition of polyolefines wastes, based on heating a melted reaction mass up to temperatures between 440°C.–470° C. in the presence of catalyst. In the mentioned temperatures volatile products are obtained, which are consequently introduced into a catalyst bed of a temperature between 350° C.–470° C., after which hydrocarbons of a narrow range of molecular weight are formed.

The catalyst belongs to the group of compounds, comprising ferrous-aluminium oxide complex, silicic acid-ferrous oxide complex and zeolites. The products, obtained according to the known methods have a broad range of molecular weights.

SUMMARY OF THE INVENTION

A method according to the invention bases on heating the disintegrated polyolefin wastes at the temperatures between 180° C. to 620° C. in a presence of heavy metals silicates as catalyst, which are used in amounts from 1 to 30% by weight, calculating on the mass of polyolefin raw material. Particularly favourite run of the reaction occurs at the temperatures between 300° C. to 450° C., using as the catalysts silicates of iron $Fe^{3+}$, cobalt $Co^{2+}$, nickel $Ni^{2+}$, manganium $Mn^{2+}$, chromium $Cr^{3+}$, copper $Cu^{2+}$, cadmium $Cd^{2+}$ which process runs the most favourably with the amount of catalyst between 5 and 10%.

The applied catalyst, after use can be recycled and reused in the process according to the invention.

The process lead according to the invention can be run in a periodic or continous way, and the raw material comprises used and waste polyethylene polypropylene, polyisobutylene, polystyrene, natural and synthetic rubber.

DETAILED DESCRIPTION OF THE PREFERRED EMBODIMENTS

In a method according to the invention properly disintegrated polyolefine raw material is placed with a determined amount of a catalyst in the heated reactor, provided with a mixer and a cooler. A content of the reactor is melted and then heated up to the temperature in which the process is run according to the invention. Vapours of a product are condensed in a cooler and then separated on a distillation column.

In a result, the low-molecular weight, liquid hydrocarbons of $C_4$–$C_{20}$ are obtained, having a remarkable isomerization and aromatization grade. Next to the petrochemical products the current product does not contain sulphur and heavy metals and it is a valuable raw material for the production of motor liquid fuels of high octane number and ecological crude oil. A method according to the invention is an effective way of the utilisation of polyolefine wastes, which are difficult waste and contaminant of the natural environment.

EXAMPLE 1

In the heated reactor, provided with a mixer, inlet pipe and outlet pipe connected with a cooler, and a manhole connected with a doser, the polyolefin raw material in amount of 180 kgs, composed of the chips of polyethylene foil and cut polypropylene forms was placed. After melting, nickel silicate $Ni(SiO_2)$ was added in amount of 15 kgs, and the content of a reactor was heated up to 380° C., which temperature was kept till forming of product vapours was stopped. After a condensation and cooling 175 kgs of an oily product were obtained, which physical characteristics is given in a table no. 1 and results of an elementary analysis are presented in a table no.2.

EXAMPLE 2

In a cylindrical reactor of 9 $m^3$ capacity provided with an automatised heating-cooling system, a mixer, an inlet opening connected with a polyethylene raw material dosing system and an inlet opening, connected with a catalyst dosing system and an inlet pipe connected with a cooler the amount of disintegrated postproduction polyethylene wastes was placed, which, when melt, filled 85% of the reactor volume. The amount of 5% of ferrous silicate was added to the melted mass and the content of a reactor was heated up to 390° C., which temperature was kept while a mixer was operating. As the product of a reaction vapourised, the raw material was added through a dozer of polyolefin raw material, keeping the level of filling a reactor at 80–85%.

After the vapours are condensed and cooled a product was obtained, which was subjected to a distillation according to ASTM D2892 under an atmospherical pressure in Podbielniak apparatus model Hyper Col series 3800, resulting the following fractions:

| | |
|---|---|
| to 170° C. | 32.3 vol. %/gasoline fraction/, |
| from 170° C. to 300° C. | 24.6 vol. %/Diesel oil N-1/, |
| from 300° C. to 350° C. | 18.4 vol. %/Diesel oil N-2/, |
| residue above 350° C. | 29.7 vol. %, |
| losses | 3.0 vol %. |

A total content of fuel faction in a product reaches 67.3 vol. %; it is higher than an analogical content in petroleum.

The gasoline fraction had an octane number. 86

TABLE 1

Physical properties of a product

| Property | Value |
|---|---|
| Density [g/cm$^2$] | 0.786 |
| Temperature of igition [° C.] | max. 20 |
| Viscosity at 80° C. [mm$^2$/s] | 1.51 |
| Calorific value [kJ/kg] | 42.12 |

TABLE 2

The elementary analysis of a product.

| Element | Content [% mol] |
|---|---|
| carbon | 85.51 |
| hydrogen | 14.13 |
| nitrogen | traces |
| sulphur | traces |
| chlorine | 0.001 |
| metals | traces |

The product of polyolefin degradation, obtained according to a method of the invention was consequently subjected to separation with fractional distillation, which course is given in table no. 3.

Table no. 3
The course of a boiling temperature of a product.

| Fraction volume (% obj.) | start point | 5 | 7,5 | 10 | 20 | 30 | 40 | 50 | 60 | 70 | 80 | 90 |
|---|---|---|---|---|---|---|---|---|---|---|---|---|
| Temperature (° C.) | 48 | 77 | 100 | 115 | 153 | 186 | 242 | 265 | 325 | 365 | 372 | 375 |

A fraction of Diesel oil /170° C.–300° C./ showed very good low-temperature properties /a cloud point and cold filter blocking temperature CFPP=(−)45° C./, and also very high cetane number of 65.

The distillation residue has an appearance of a slag wax and it contains mainly higher parafine hydrocarbons. In the distillation tests of this fraction it was found, that over 90% distillates in the range of 350°C.–450° C. Simultaneously a possibility of recycling that fraction to the reaction for resulting fuel fraction has been fully confirmed.

What is claimed is:

1. A method for obtaining liquid fuels from polyolefin waste, comprising heating properly disintegrated polyolefin raw material at a temperature between 180° C. and 620° C. to decomposition in the presence of catalysts comprising heavy metal silicates added in an amount of 1–30% by weight based on the polyolefin raw material, and distilling the resultant products.

2. The method according to claim 1, wherein the step of heating is performed at a temperature between 300–450° C.

3. The method according to claim 1, wherein the catalyst comprises iron $Fe^{3+}$ silicate.

4. The method according to claim 1, wherein the catalyst comprises cobalt $Co^{2+}$ silicate.

5. The method according to claim 1, wherein the catalyst comprises nickel $Ni^{2+}$ silicate.

6. The method according to claim 1, wherein the catalyst comprises manganese $Mn^{2+}$ silicate.

7. The method according to claim 1, wherein the catalyst comprises chromium $Cr^{3+}$ silicate.

8. The method according to claim 1, wherein the catalyst comprises copper $Cu^{2+}$ silicate.

9. The method according to claim 1, wherein the catalyst comprises zinc $Zn^{2+}$ silicate.

10. The method according to claim 1, wherein the catalyst comprises cadmium $Cd^{2+}$ silicate.

11. The method according to claim 1, wherein the catalyst comprises a mixture of two or more catalysts.

12. The method according to claim 1, wherein the catalyst is in an amorphous form.

13. The method according to claim 2, wherein the catalyst is added in amount from 5 to 10% by weight, based on mass of the raw material.

14. The method according to claim 1, wherein the catalyst is recycled and used multiply.

15. The method according to claim 1, wherein the method is run continuously.

16. The method according to claim 1 wherein the polyolefin raw material is selected from the group consisting of polyethylene, polypropylene, polyisobutylene, polystyrene, and natural and synthetic rubber.

* * * * *